US007775273B2

(12) United States Patent
Merlau et al.

(10) Patent No.: US 7,775,273 B2
(45) Date of Patent: Aug. 17, 2010

(54) TOOL USING OUTPUTS OF SENSORS RESPONSIVE TO SIGNALING

(75) Inventors: David Merlau, Friendswood, TX (US); Lang Zhan, Pearland, TX (US); Dhandayuthapani Kannan, Missouri City, TX (US); Jim B. Benton, Huffman, TX (US)

(73) Assignee: Schlumberber Technology Corporation, Sugar Land, TX (US)

( * ) Notice: Subject to any disclaimer, the term of this patent is extended or adjusted under 35 U.S.C. 154(b) by 54 days.

(21) Appl. No.: 12/179,978

(22) Filed: Jul. 25, 2008

(65) Prior Publication Data

US 2010/0018714 A1 Jan. 28, 2010

(51) Int. Cl.
*E21B 47/00* (2006.01)
*E21B 34/06* (2006.01)

(52) U.S. Cl. ..... 166/250.01; 166/373; 166/386

(58) Field of Classification Search ..... 166/53, 166/66.6, 151, 250.1, 316, 373, 386; 73/152.51, 73/151.52

See application file for complete search history.

(56) References Cited

U.S. PATENT DOCUMENTS

| | | | | |
|---|---|---|---|---|
| 4,796,699 | A | 1/1989 | Upchurch | |
| 4,856,595 | A | 8/1989 | Upchurch | |
| 4,896,722 | A | 1/1990 | Upchurch | |
| 4,915,168 | A | 4/1990 | Upchurch | |
| 4,971,160 | A | 11/1990 | Upchurch | |
| 5,050,675 | A | 9/1991 | Upchurch | |
| 5,691,712 | A | 11/1997 | Meek | |
| 6,173,772 | B1 * | 1/2001 | Vaynshteyn | 166/250.15 |
| 6,182,764 | B1 | 2/2001 | Vaynshteyn | |
| 6,199,629 | B1 * | 3/2001 | Shirk et al. | 166/66.4 |
| 6,360,820 | B1 | 3/2002 | Laborde | |
| 6,439,306 | B1 | 8/2002 | Patel | |
| 6,536,522 | B2 * | 3/2003 | Birckhead et al. | 166/250.15 |
| 6,536,529 | B1 | 3/2003 | Kerr | |
| 6,688,390 | B2 | 2/2004 | Bolze | |
| 6,848,510 | B2 | 2/2005 | Bixenman | |
| RE039,583 | E | 4/2007 | Upchurch | |
| 7,198,102 | B2 | 4/2007 | Virally | |
| 7,231,971 | B2 * | 6/2007 | McCalvin | 166/250.01 |
| 7,243,536 | B2 | 7/2007 | Bolze | |
| 7,380,599 | B2 | 6/2008 | Fields | |
| 7,469,748 | B2 | 12/2008 | Ocalan | |
| 7,478,555 | B2 | 1/2009 | Zhan | |
| 2002/0020533 | A1 * | 2/2002 | Tubel | 166/313 |
| 2004/0035578 | A1 * | 2/2004 | Ross et al. | 166/250.15 |
| 2006/0266526 | A1 | 11/2006 | Ocalan | |
| 2007/0227731 | A1 | 10/2007 | Contant | |
| 2007/0295504 | A1 | 12/2007 | Patel | |
| 2008/0128130 | A1 | 6/2008 | Whitsitt | |
| 2008/0135299 | A1 | 6/2008 | Fields | |

(Continued)

*Primary Examiner*—Daniel P Stephenson
*Assistant Examiner*—Michael Wills, III
(74) *Attorney, Agent, or Firm*—Kevin B. McGoff; Rodney Warfford

(57) ABSTRACT

An apparatus for use in a wellbore includes a tool string and a plurality of sensors, which include at least a first sensor to detect pressure signals in an inner conduit of the tool string and at least a second sensor to detect pressure signals in an annulus outside the tool string. A controller actuates a tool in the tool string in response to a logical combination of outputs from the sensors, where the outputs of the sensors are responsive to the respective pressure signals.

26 Claims, 8 Drawing Sheets

U.S. PATENT DOCUMENTS

2008/0140369 A1 6/2008 Rashid
2009/0033516 A1* 2/2009 Alteirac et al. ..... 340/853.2
2009/0044951 A1 2/2009 Milkovisch

* cited by examiner

TOOL USING OUTPUTS OF SENSORS RESPONSIVE TO SIGNALING

TECHNICAL FIELD

The invention relates to actuating a tool using outputs of sensors that are responsive to signaling.

BACKGROUND

To perform various operations in a well, downhole tools can be conveyed into the well. The downhole tools can be conveyed on various types of carrier structures, including wireline, tubing, and so forth. Tubing-conveyed downhole tools are used when safety concerns, reliability issues, and/or wellbore deviation make wireline conveyed operations difficult or unreliable.

Examples of downhole tools that can be conveyed on tubing include the following: a test valve to control the opening or closure of a flow passageway inside the tubing or tool string; a circulating or sleeve type valve to control communication between the flow passageway inside the tubing or tool string and an annulus outside the tubing or tool string; a firing system to detonate shaped charges in perforating guns; fluid samplers to capture representative downhole fluid samples, and so forth. Because of the absence of wireline, operations of tubing-conveyed tools are usually controlled by pressure pulse signals sent from the earth surface through completion fluids in the annulus between the outside diameter of the tubing/tool string and well casing.

A pressure sensor can be provided to receive pressure signals sent from the earth surface in the tubing-to-casing annulus. A downhole control module can be used to decode the annulus pressure signals to operate downhole tool(s). A benefit of pressure signal control is that only low operational pressure stimuli are needed in the annulus, which may help to reduce the likelihood of casing or tool string collapse or failure if high hydraulic pressures were used instead to control tool actuation.

Alternatively, instead of providing pressure sensors to detect annulus pressure stimuli, other implementations can instead use a pressure sensor to detect pressure stimuli inside tubing.

However, conventional pressure stimuli control mechanisms suffer from inflexibility.

SUMMARY

In general, according to an embodiment, an apparatus for use in a wellbore includes a tool string and a plurality of sensors including at least a first sensor to detect pressure signals in an inner conduit of the tool string and at least a second sensor to detect pressure signals in an annulus outside the tool string. A controller actuates a tool in the tool string in response to a logical combination of outputs from the sensors, wherein the outputs of the sensors are responsive to the respective pressure signals.

Other or alternative features will become apparent from the following description, from the drawings, and from the claims.

DETAILED DESCRIPTION

Figure 1:
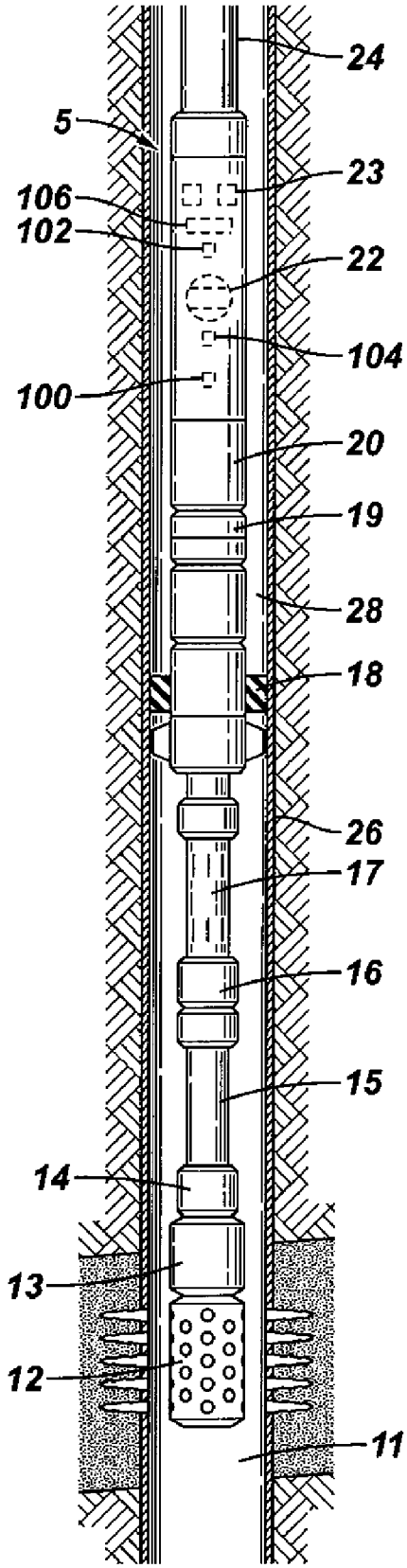
FIG. 1 depicts an example tool string for well perforating and testing that incorporates an embodiment of the invention.

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a pressure-stimuli control mechanism is provided for controlling actuation of a downhole tool (or downhole tools). The pressure-stimuli control mechanism is responsive to some combination of pressure stimuli communicated from an earth surface location above the wellbore through an annulus outside a tool string (which is deployed into the wellbore with a tubular structure) and through an inner conduit of the tool string and tubular structure. A tubular structure to convey downhole tool(s) into a wellbore is referred to as a "conveyance tubular structure." Examples of a conveyance tubular structure include coiled tubing, jointed tubing, a pipe, and so forth. Although reference is made to "tubular," note that the cross-sectional profile of the conveyance tubular structure does not have to be circular—in fact, the cross-sectional profile of the conveyance tubular structure can have one of other shapes, such as oval, rectangular, or any other arbitrary shape.

The pressure-stimuli control mechanism has pressure stimuli sensors to detect pressure signaling in the annulus and in the inner conduit of the tool string and conveyance tubular structure. The pressure-stimuli control mechanism can be responsive to some logical combination of the pressure signaling in the annulus and the inner conduit, as detected by respective pressure sensors.

The pressure signaling is in the form of relatively low amplitude pressure pulses (e.g., a sequence of pressure pulses). Different sequences of pressure pulses are used to encode different commands that can be sent from the earth surface. Pressure signaling is distinguished from elevated hydraulic pressure, which usually has a relatively high amplitude.

Note that the pressure sensors can also detect pressure changes caused by fluid flow in the annulus and/or inner conduit. Detected pressure changes due to fluid flow can be used as further information to determine whether or not tool actuation is to be performed.

In one example arrangement, there can be at least one pressure stimuli sensor to detect pressure stimuli communicated through the annulus outside the conveyance tubular structure, and at least two pressure sensors to detect pressure stimuli communicated through the inner conduit of the tool string/conveyance tubular structure. One of the two pressure stimuli sensors to detect pressure stimuli inside the inner conduit can be positioned above an isolation valve (referred to as a "test valve" below), while the other one is positioned below the isolation valve. In other implementations, different numbers of pressure stimuli sensors can be used for detecting pressure stimuli provided through the annulus and/or through the inner conduit. The signals detected by the sensors can be used to determine a state of a downhole tool (e.g., whether the tool is open/closed or other state).

In one example, it is assumed that pressure sensor A detects pressure stimuli in the annulus, pressure sensor B detects pressure stimuli in the inner conduit above the isolation valve, and pressure sensor C detects pressure stimuli in the inner conduit below the isolation valve. In this example arrangement, the pressure-stimuli control mechanism can be used to control actuation of a downhole tool in response to any of the following events:

(1) both sensor A and sensor B detect specific signals at the same time (A signal shape can be same as or different from B signal shape);
(2) both sensor A and sensor C detect specific signals at the same time (A signal shape can be same as or different from C signal shape);
(3) both sensor B and sensor C detect specific signals at the same time (B signal shape can be same as or different from C signal shape);
(4) all sensors A, B, and C detect specific signals at the same time (all signals may have the same shape or may have different shape);
(5) one of sensors A and B detect a specific signal;
(6) sensor A detects a specific signal, then sensor B detects another specific signal (these two signals occur sequentially);
(7) sensor B detects a specific signal, then sensor A detects another specific signal (these two signals occur sequentially); or
(8) any other possible logical combination of signals from sensors A, B, and C.

Note that reference to "same time" or "the same shape" of signals as used herein means that differences of the signals are within predefined error bounds in terms of time or shape, respectively.

Moreover, the pressure-stimuli control mechanism can be further responsive to other types of signaling, such as electromagnetic (EM) signaling and/or acoustic signaling transmitted from the surface. Other types of signaling can also include electrical signaling sent over one or more wires. These other types of signaling can be considered together with the pressure stimuli as detected by the pressure stimuli sensors when determining whether a downhole tool is to be actuated.

FIG. 1 shows an example tool string 5 used for a perforating and testing job in a wellbore 11, which can be lined with casing 26. The arrangement depicted in FIG. 1 is provided for purposes of example, as other embodiments can use other tool arrangements. For example, some of the components depicted in FIG. 1 can be omitted or replaced with other types of components. One of the such variants is that the perforating related components can be omitted without affecting the purpose of the reservoir testing.

The tool string 5 is run into a well and suspended in the wellbore 11 with the perforating gun 12 positioned adjacent a target zone of a subterranean formation. A safety spacer 13 and a firing head 14 can be installed above the perforating gun 11 to detonate charges in the perforating gun 12. A blank tubing section 15 can be provided above the firing head 14, and a debris sub 16 and slotted tail pipe 17 can be provided above the blank tubing section 15 to allow communication between wellbore 11 and an inner bore of the tool string 5.

A packer 18 can be set to isolate a lower part of the lower wellbore 11 from an upper part 28 of the wellbore. A safety joint 19 and hydraulic jar 20 can be installed above the packer 18 to provide a quick release of an upper portion of the tool string from a lower portion of the tool string.

In accordance with some embodiments, pressure stimuli sensors can also be provided in the tool string 5 for the purpose of detecting pressure stimuli for actuating certain tools in the tool string 5. The pressure stimuli sensors include a first pressure stimuli sensor 100 to detect pressure stimuli communicated from the earth surface through the tubing-casing annulus 28, a second pressure stimuli sensor 102 to detect pressure stimuli (above a test valve 22) in an inner bore of the tool string 5, and a third pressure stimuli sensor 104 to detect pressure stimuli (below the test valve 22) in the inner bore of the tool string 5. As noted above, the test valve 22 can be an isolation valve—when the test valve 22 is closed, the test valve 22 isolates the parts of the inner bore of the tool string 5 above and below the test valve 22.

The pressure stimuli in the inner bore of the tool string 5 can be communicated from the earth surface through an inner conduit of a conveyance tubular structure 24 that carries the tool string 5 inside the wellbore 11.

Although not shown, other sensors can also be part of the tool string 5, which can be used to record various other types of measurements, such as temperature, flow rate, pressure, and so forth.

A controller 106 is also provided to receive outputs of at least the pressure stimuli sensors 100, 102, and 104, and possibly to receive outputs of other sensors. The controller 106 is responsive to some logical combination of the sensor outputs to control actuation of one or more tools in the tool string 5.

The test valve 22 can be implemented with a ball type valve, in one example. When opened and closed, the test valve 22 controls fluid flow through the inner bore of the tool string 5. Opening the test valve 22 allows fluid to flow through the inner bore of the tool string 5—the fluid flow can include production fluid from the formation or injection fluid into the formation. When closed, the test valve 22 isolates the parts of the tool string inner bore above and below the test valve 22.

A circulating valve 23 in the tool string 5 permits or prevents fluid flow between the inner bore of the tool string and the wellbore annulus 28. When the test valve 22 is closed, opening the circulating valve 23 enables lifting of formation fluid in the conveyance tubular structure 24 above the test valve 22 in response to injecting working fluid into the wellbore annulus 28.

Some operations that can be performed with the tool string 5 involve actuation or control of the test valve 22, circulating valve 23, packer 18, and/or firing head 14. Such downhole tools (along with other tools) can be controlled by a controller 106 that is able to receive information from the pressure stimuli sensors 100, 102, and 104.

Figure 2:
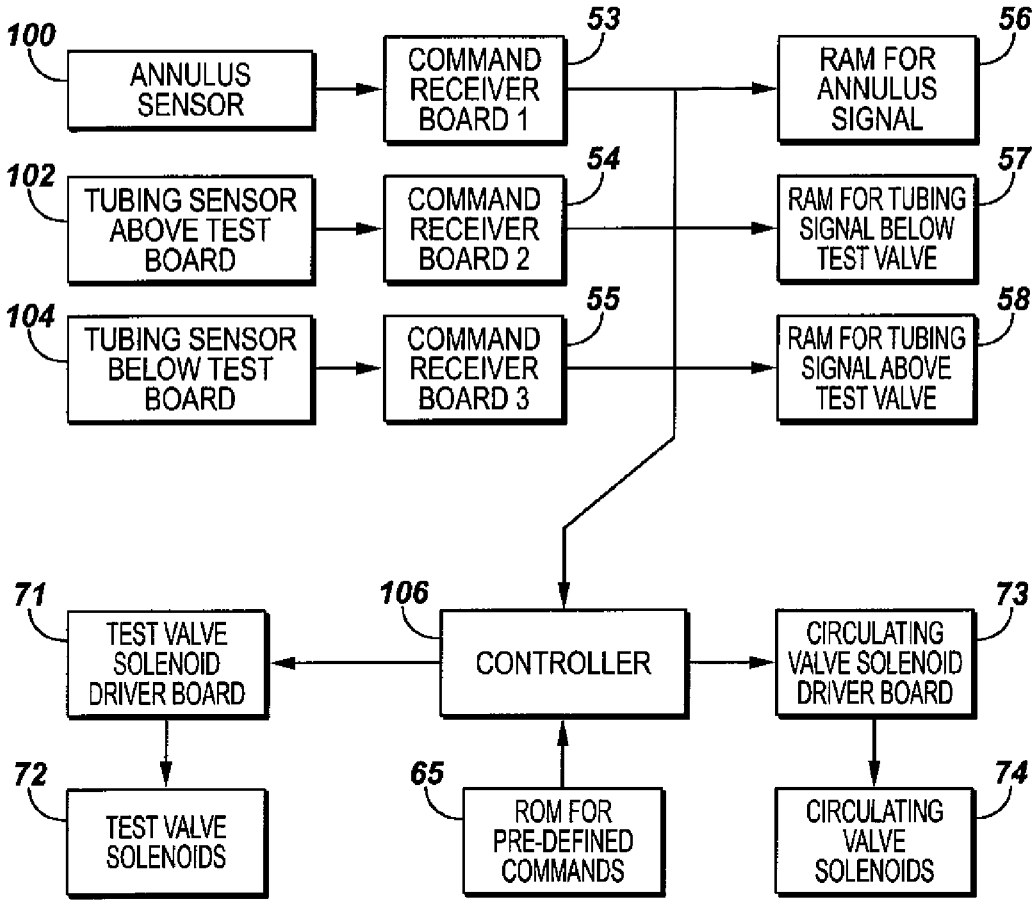
FIG. 2 is a flow diagram of a process to control the test valve and circulating valve, according to an embodiment.

FIG. 2 shows an embodiment of this invention for controlling the downhole test valve 22 and circulating valve 23. Note that similar techniques can be used for controlling other downhole tools in the tool string 5. At least one pressure sensor 100 is ported to the tubing-to-casing annulus 28 above the packer 18. At least one pressure sensor 102 is ported to the inner bore of tool string (which communicates with the inner conduit of the conveyance tubular structure 24) above the test valve 22. At least one pressure sensor 104 is ported to the inner bore of tool string below the test valve 22. The responsive signal from each of these three pressure sensors is sent to the corresponding command receiver boards 53, 54 or 55, respectively, where the signals can be passed through analog-to-digital (A/D) converters, and/or other signal processing circuitry.

The converted or processed signals are stored in corresponding storage devices (e.g., random access memories) 56, 57 or 58, respectively. Note that alternatively one storage device can be provided to store all of the outputs from the sensors 100, 102, 104. The signals are also transmitted to the controller 106, which can include, for example, one or more microprocessors and/or other processing circuitry. The pressure signals detected by the sensors 100, 102, 104 are decoded by the controller 106 to compare with predefined signatures (corresponding to operational commands) stored in non-volatile memory 65 (e.g., electrically erasable read-only-memory or flash memory). There are many potential valve operations based on the identified commands.

The following operations can be performed in response to the comparison of decoded signals with predefined signatures. If the decoded signals match a predefined signature for operating the test valve 22, the corresponding command is sent by the controller 106 to a test valve solenoid driver board 71, which in turn initiates the desired actuation of test valve solenoids 72 to operate the test valve 22. The operating of the test valve 22 includes completely opening or closing the valve, or setting the valve to any intermediate open position.

If the decoded signals match a predefined signature for operating the circulating valve 23, the corresponding command is sent by the controller 106 to a circulating valve solenoid driver board 73, which in turn initiates actuation of circulating valve solenoids 74 for operating the circulating valve 23. The operating of the circulating valve 23 includes completely opening or closing of the valve, or setting the valve to any intermediate opening position.

If the decoded signals match a predefined signature for operating both the test valve and circulating valve, the corresponding commands are sent to both the test valve solenoid driver board 71 and the circulating valve solenoid driver board 73. The two driver boards 71 and 73 in turn initiate actuation of both the test valve solenoids 72 and the circulating valve solenoids 74. The actuation of the test valve 22 and circulating valve 23 includes completely opening or closing of both valves, completely opening one valve and closing the other valve, or setting one or both of the valves to any intermediate opening position. In this description, reference is made to opening or closing of valves. It is understood that opening or closing can often indicate a relative valve operation, i.e., the valve is operated to increase the opening of the valve or decrease the opening of the valve.

Note that the various electronic devices depicted in FIG. 2 can be powered by a downhole power source, such as a downhole battery (not shown).

Actuation of solenoids can involve actuating solenoid valves using a control hydraulic mechanism, such as that described in U.S. Pat. No. 4,915,168, entitled "Multiple Well Tool Control Systems In A Multi-Valve Well Testing System," which is hereby incorporated by reference.

As further depicted in FIG. 2, the sensors 100, 102, and 104 are connected to respective electrical links 110, 112, and 114 (which can be part of one cable or multiple cables). The electrical links 110, 112, and 114 can extend to earth surface equipment. The sensors can be responsive to signals sent over the electrical links 110, 112, 114.

In some implementations, the sensors 100, 102, and 104 can further act as communications interfaces between the electrical links 110, 112, and 114 and other components depicted in FIG. 2, such as the controller 106 and/or storage devices 56, 57, 58. In this way, commands can be sent over the electrical links 110, 112, 114 to the controller 106 to cause actuation of downhole tool(s). Alternatively, data stored in the storage devices 56, 57, 58 can be retrieved through the interfaces provided by the sensors 100, 102, 104 for communication to the earth surface. As yet another alternative, software instructions can be sent down the electrical links 110, 112, 114 to re-program the controller 106.

In another embodiment, the electrical links 110, 112, 114 can communicate with the controller 106 and/or storage devices 56, 57, 58 via one or more independent interfaces that are installed in the tool string.

Figure 3:
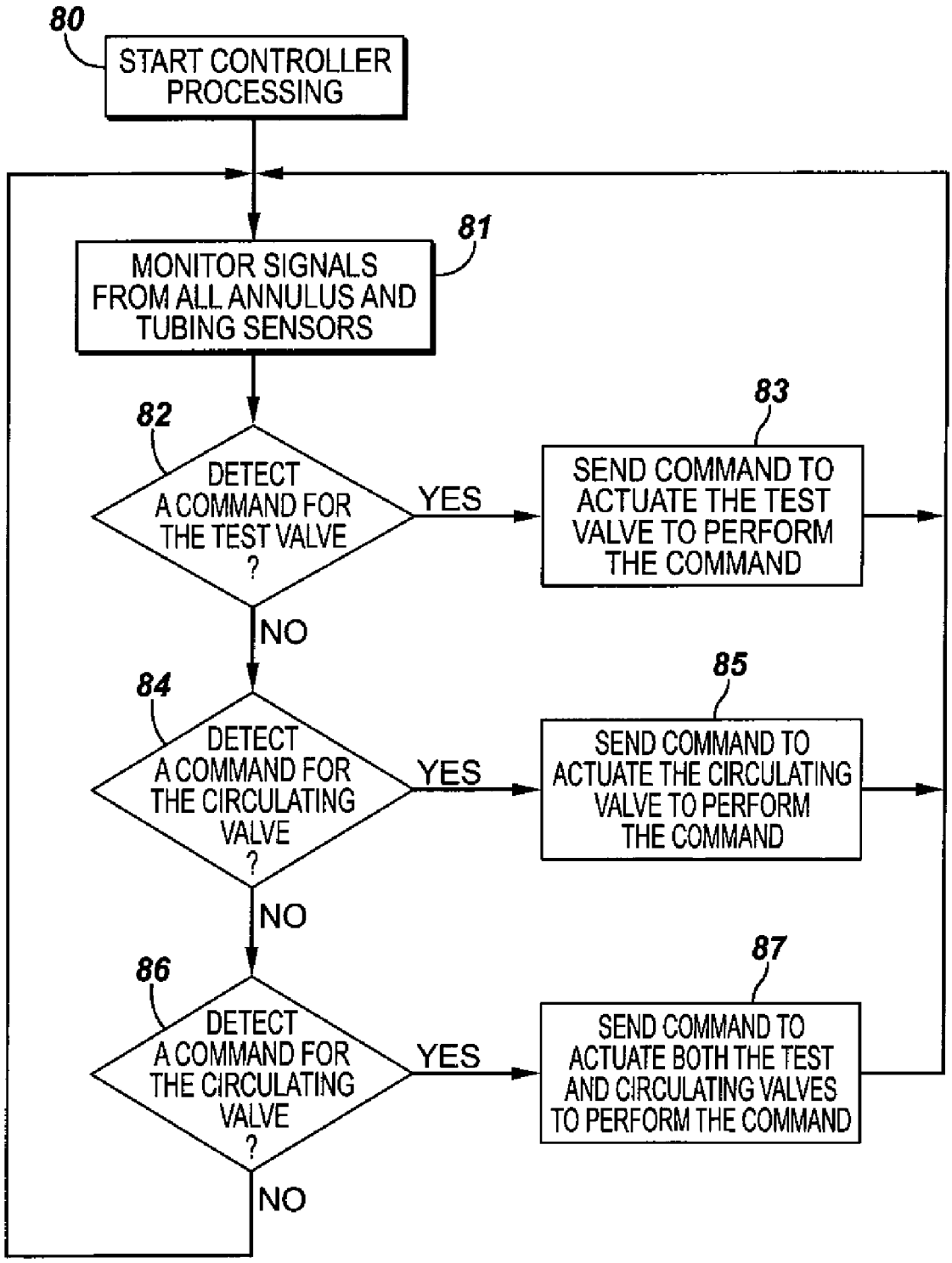
FIG. 3 is a flow diagram of a process to detect and perform a command for valve actuation in a controller, in accordance with an embodiment.

A more detailed procedure to detect a command to actuate the test valve and/or circulating valve and to perform the responsive processing is illustrated in FIG. 3. The controller 106 starts (at 80) to process the incoming signals in block 80. The controller 106 continually monitors (at 81) detected annulus and tubing pressure stimuli from pressure stimuli sensors 100, 102, 104. In each incremental time interval, the controller 106 determines (at 82) if a test valve command has been received (based on comparing pressure pulse stimuli to a predetermined signature for the test valve command). If a command to operate the test valve is detected, the controller 106 sends (at 83) a command to actuate the test valve 22 by energizing associated solenoids. The process then returns to block 81 to continually monitor for further incoming signals.

If the test valve operation command is not detected in block 82, the controller 106 next determines (at 84) if a command for the circulating valve 23 has been received. If the circulating valve command is detected, the controller 106 sends (at 85) a command to actuate the circulating valve 23 by energizing associated solenoids. The process then returns to block 81 to monitor for further incoming signals.

If the circulating valve operation command is not detected in the block 84, the controller 106 next determines (at 86) if a command to operate both the test and circulating valves has been received. If the command to operate both the test valve and circulating valve was received, the controller 106 sends (at 87) a command to actuate both the test valve and circulating valve by energizing the associated solenoids in block 87. The process then returns to block 81 to monitor for further commands.

If the command to operate both the test and circulating valves is not detected in the block 86, the process returns to block 81 to check for other operational commands.

Example pressure stimuli, which can be used to actuate the test valve 22 and/or circulating valve 23, are depicted in FIG.

Figure 4A:
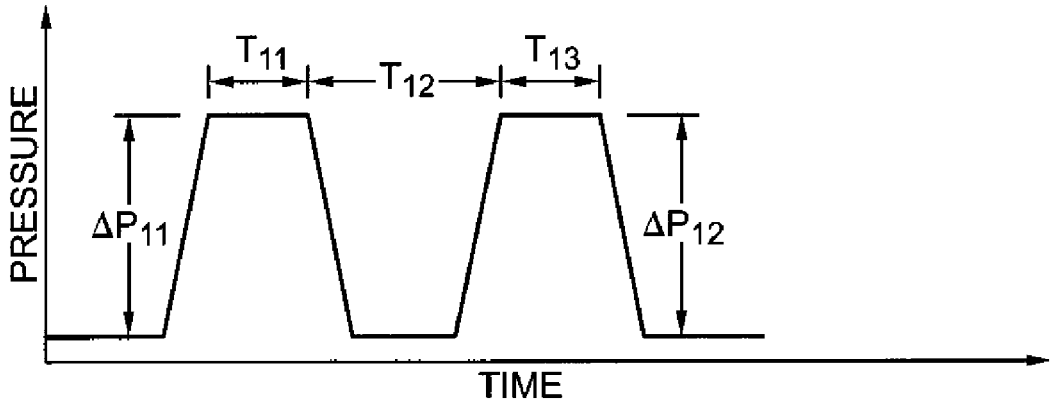
FIGS. 4A-4C are timing diagrams of pressure stimuli that are detectable by pressure stimuli sensors, according to an example embodiment.

4A-4C. For example, the annulus pressure stimuli can include two sequential pressure pulses, as shown in FIG. 4A. The first pressure pulse has amplitude $\Delta P_{11}$ (from a baseline pressure), and the second pressure pulse has amplitude $\Delta P_{12}$ from the baseline pressure. The first pressure pulse has time duration $T_{11}$, and the second pressure pulse has time duration $T_{13}$. A time delay $T_{12}$ is present between the first and second pressure pulses.

In one example embodiment, the two pressure pulses can have substantially equal amplitudes, in other words, $\Delta P_{11}$ can be substantially equal to $\Delta P_{12}$. Also, $T_{11}$ can be substantially equal to $T_{13}$. In other implementations, $\Delta P_{11}$ and/or $T_{11}$ can be different from $\Delta P_{12}$ and/or $T_{13}$, respectively.

The pressure stimuli that can be provided in the inner bore of the tool string 5 and detectable by the pressure sensors (above and below the test valve 22) can have similar characteristics as that of the annulus pressure stimuli, such as those depicted in FIGS. 4B and 4C. To differentiate pressure stimuli for different sensors, at least one of the characteristics (e.g., amplitude and/or pulse duration) of the pressure pulses can be defined to distinguish different pressure stimuli. The pressure stimuli of FIGS. 4A-4C differ from each other in terms of pressure pulse durations. The first pressure pulse durations $T_{11}$, $T_{21}$ and $T_{31}$ of the pressure stimuli for the annulus sensor, tubing sensor above the test valve and tubing sensor below the test valve, respectively, may be substantially different with each other. Similarly, the second pressure pulse durations $T_{13}$, $T_{23}$ and $T_{33}$ of the pressure stimuli for the annulus sensor, tubing sensor above the test valve and tubing sensor below the test valve, respectively, may be substantially different with each other. Also, the time delays between the two pressure pulses, $T_{12}$, $T_{22}$ and $T_{32}$, can be different.

Alternatively, first pressure pulse amplitudes $\Delta P_{11}$, $\Delta P_{21}$ and $\Delta P_{31}$ of the pressure stimuli for the annulus sensor, tubing sensor above the test valve and tubing sensor below the test valve, respectively, may be substantially different with each other. Also, the second pressure pulse magnitudes $\Delta P_{12}$, $\Delta P_{22}$ and $\Delta P_{32}$ of the pressure stimuli for the annulus sensor, tubing sensor above the test valve and tubing sensor below the test valve, respectively, may be substantially different with each other.

Note that although just one of the characteristics of the pressure pulses can be made to be different to distinguish different pressure stimuli for different sensors, in another implementation, two or more characteristics of the pressure pulses can be set to be differ to enhance reliability of command identification from the sensor responses.

Figure 4B:
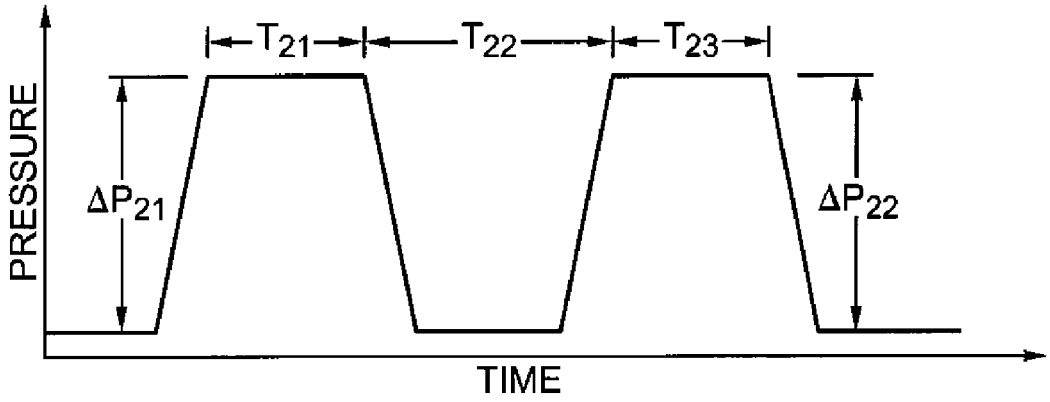
Figure 4C:
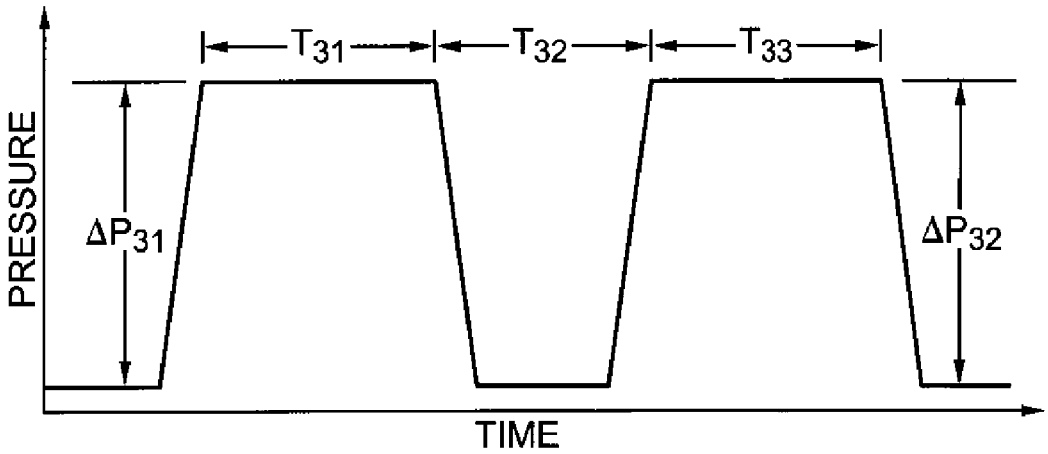
Figure 5:
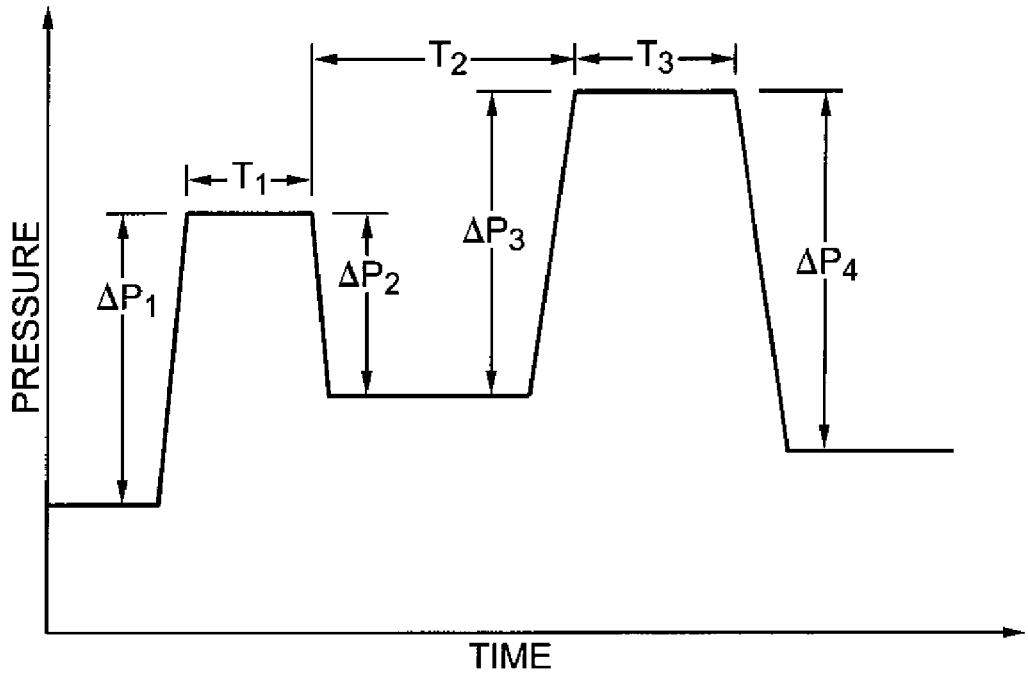
FIG. 5 is a timing diagram of a command having a particular waveform, in accordance with an embodiment.

In another embodiment, instead of using regular pulses as depicted in FIGS. 4A-4C, the pulses can have different rise and fall profiles, as well as different durations, as depicted in FIG. 5. FIG. 5 shows a pressure pulse sequence in which two or more of time durations $T_1$, $T_2$ and $T_3$ may be substantially different, and/or two or more of pressure pulse amplitudes $\Delta P_1$, $\Delta P_2$, $\Delta P_3$ and $\Delta P_4$ may be substantially different. The amplitudes of the pressure pulses may be positive or negative.

The ability to use responses from more than one pressure sensor for actuating a downhole tool can be beneficial in many scenarios. For instance, the circulating valve 23 is usually closed before opening the test valve 22 to flow the formation fluid from below the test valve to above the test valve. If the circulating valve 23 is not closed when the test valve 22 is opened, the formation fluid may enter the tubing-casing annulus 28 above the packer 18 (FIG. 1). This can be a hazardous situation. Therefore, it is desirable to ensure that the circulating valve 23 is closed before actuating the test valve 22. A single sensor command (a command associated with just a single pressure stimuli sensor) man not be able to ensure a desirable condition is met for the test valve operation in this situation. If the circulating valve 23 is still open, the pressure pulses sent through annulus 28 will also be communicated to the inner bore of the tubing string 5 so that there is flow communication between the wellbore annulus 28 and the inner bore of the tubing string 5. As a result, the pressure stimuli detected by the annulus pressure sensor 100 and the tubing pressure sensor 102 above the test valve 22 would be the same. On the other hand, if the circulating valve is closed, the pressure pulses in the annulus 28 will only be detected by the annulus pressure sensor 100, while the tubing pressure sensors would not detect the annulus pressure stimuli. Thus, using both the annulus and tubing pressure responses in a systematic way will create more robust and reliable commands for test valve (or other downhole tool) operations. A command based on pressure responses from multiple pressure stimuli sensors is referred to as a "multi-sensor command."

Figure 6:
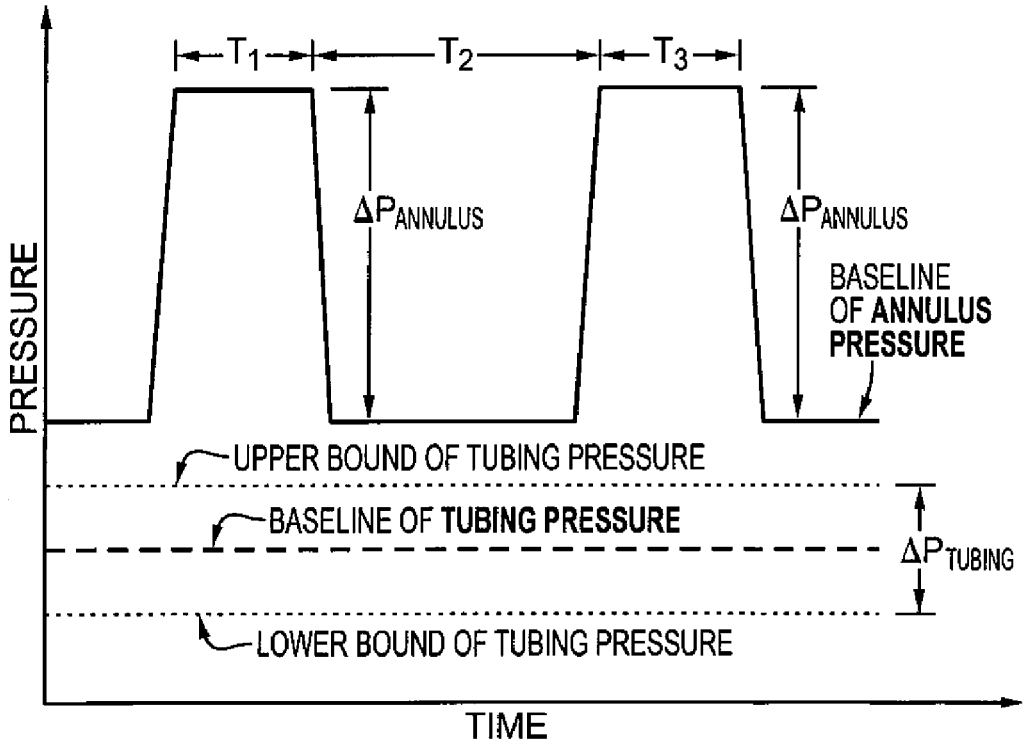
FIG. 6 are timing diagrams of pressure responses at annulus and tubing sensors due to two pressure pulses in the annulus when a circulating valve is closed, in accordance with an example.

FIG. 6 illustrates example pressure responses of the annulus sensor 100 and upper tubing sensor 102 above the test valve for two pressure pulses sent through the annulus 28 when the circulating valve 23 is closed. If the test valve 22 is also closed, the magnitude of the pressure pulses $\Delta P_{annulus}$ obtained from the annulus sensor 100 is substantially larger than the pressure fluctuation $\Delta P_{tubing}$ measured by the upper tubing sensor 102. On the other hand, if the circulating valve is open, the pressure responses from the two sensors 100 and 102 would be substantially the same, or the fluctuation magnitude $\Delta P_{tubing}$ would be substantially larger than if the circulating valve is closed.

Figure 7:
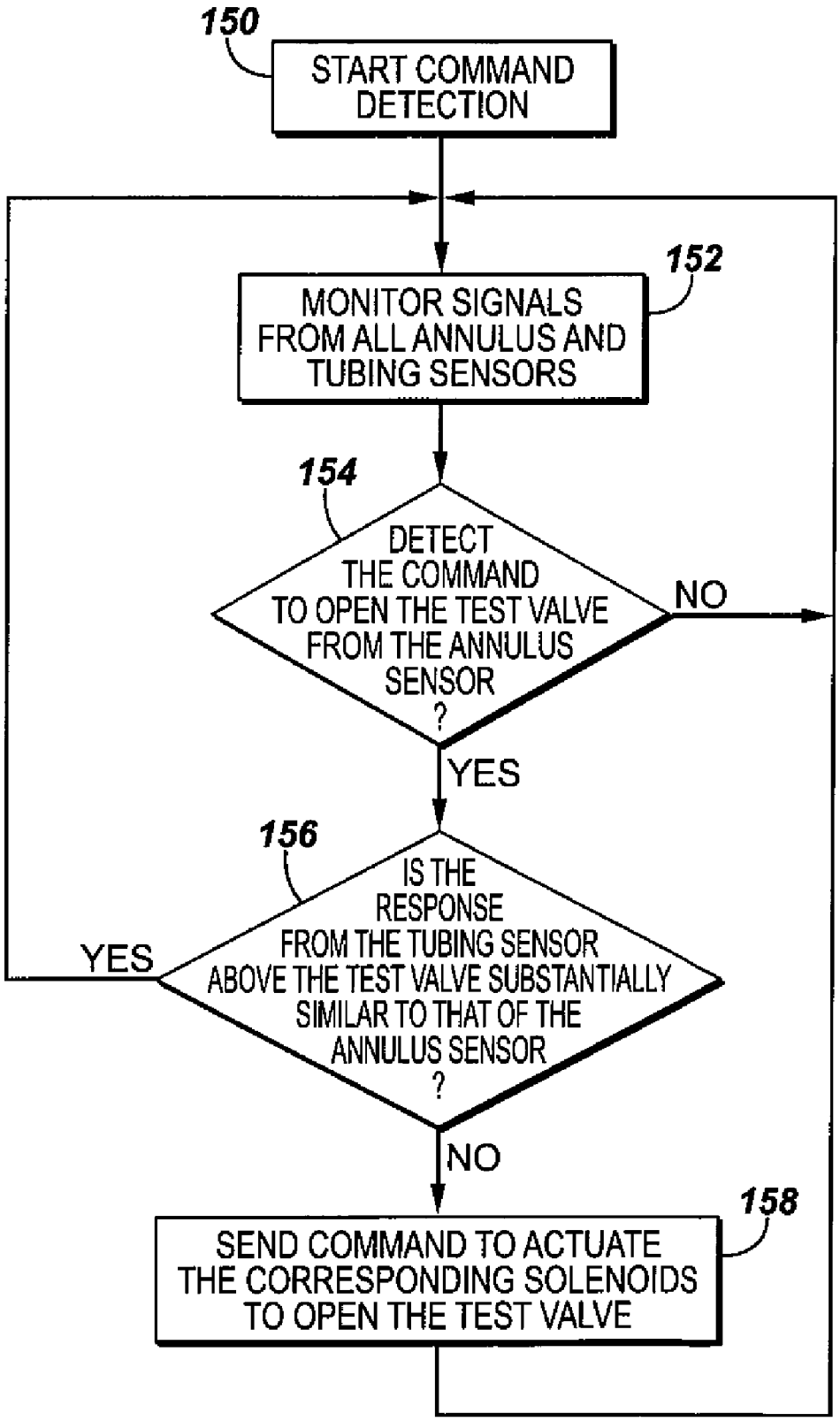
FIG. 7 is a flow diagram of a process to actuate a test valve, in accordance with an embodiment.

FIG. 7 depicts a procedure to actuate a test valve 22, according to an example embodiment. The command detection starts (at 150). Incoming signals are monitored continually (at 152) by the controller 106. In each predetermined incremental time interval, the measured annulus sensor response is compared (at 154) to the predefined signature of the open test valve command. If the open test valve command is not detected, the process returns to block 152 to continue detection for signals at the next time interval. If the open test valve command is detected, then the response from the upper tubing pressure sensor 102 is further checked (at 156). If the response from the upper tubing pressure sensor 102 is substantially similar to that of the annulus pressure sensor 100, the circulating valve is still open, and therefore, the process returns to block 152 without actuating the test valve.

However, if the pressure response from the upper tubing sensor 102 has a substantially lower fluctuation, in other words, $\Delta P_{tubing}$ depicted in FIG. 6 is substantially smaller than $\Delta P_{annulus}$, the circulating valve is confirmed to be closed, and so the corresponding command is sent (at 158) by the controller 106 to energize the associated solenoids to open the test valve 22. After test valve actuation, the process returns to block 152 to check for the next command in the next time interval.

The two-sensor command in FIG. 7 is provided as an example of a multi-sensor command. In other examples, a multi-sensor command can be based on responses from three or even more sensors.

Figure 8:
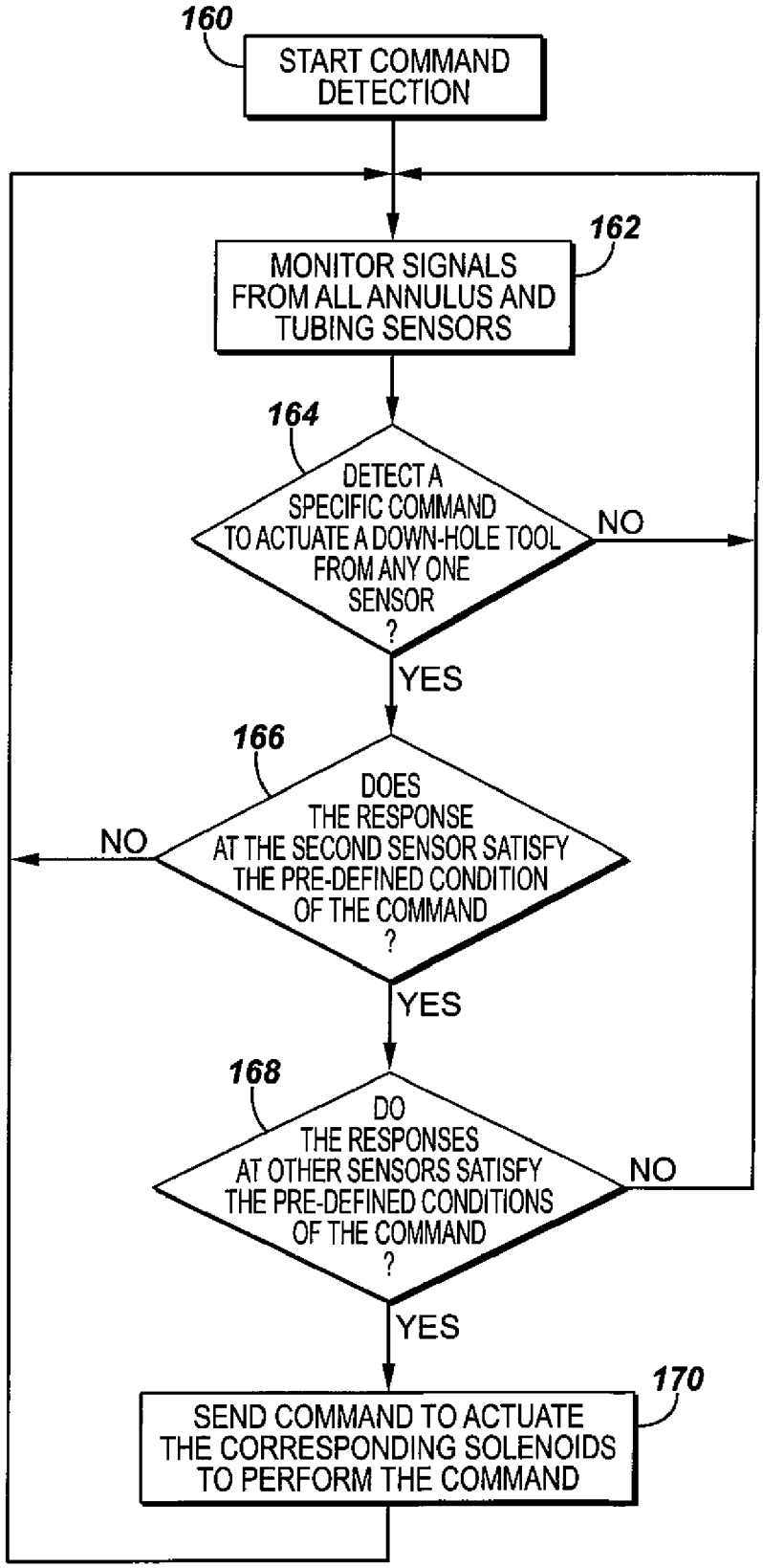
FIG. 8 is a flow diagram of general procedures of using a multi-sensor command to actuate downhole tools, in accordance with an embodiment.

FIG. 8 shows a procedure to operate a downhole tool according to one embodiment using a multi-sensor command. The command detection starts (at 160). The controller 106 continually monitors (at 162) incoming pressure signals based on responses from annulus and tubing sensors in each time interval. In each incremental time interval, the responses from all sensors are compared (at 164) to predefined signatures corresponding to downhole tool commands. If none of commands is detected, the process returns to block 162 to continue the detection for commands in the next time interval.

If a specific command is detected from one of the multiple pressure stimuli sensors, then the sensor is denoted as the first sensor, and the response from the second sensor from among the multiple sensors is checked (at 166) to determine whether a predefined condition of the command for this second sensor is satisfied. If the condition is not satisfied, the command is not executed, and the process returns to block 162. If the condition of the command for the second sensor is satisfied, the process proceeds to block 168 if more sensors exist. Similar to block 166, responses from third or more sensors, if present, are checked to determine whether the corresponding predefined condition(s) for such other command(s) is (are) met. If not, the process returns to block 162. If the conditions of the command for all sensors are satisfied, the controller 106 sends (at 170) an instruction to execute the command for the downhole operation. Next, the process returns to the block 162.

Figure 9:
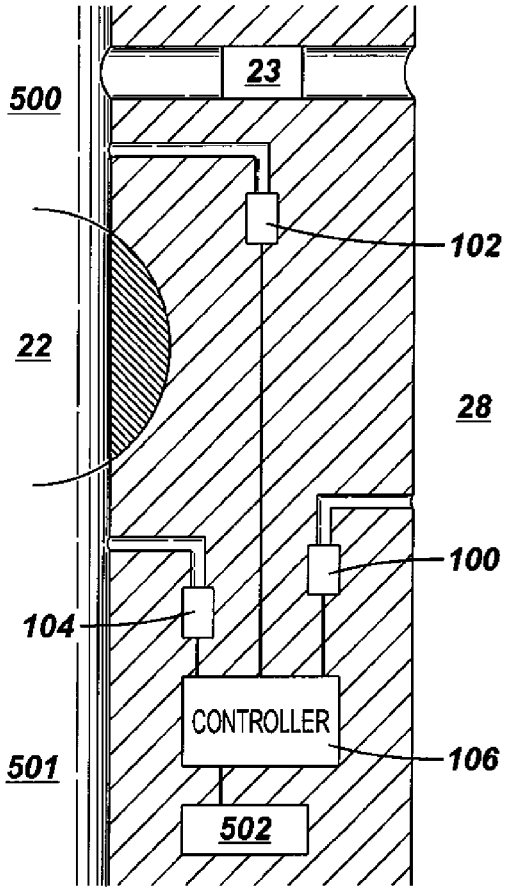
FIG. 9 is a schematic diagram of an arrangement of three pressure stimuli sensors ported to annulus and tubing for test valve and circulating valve control, according to an embodiment.

A schematic diagram of an embodiment of an arrangement that includes multiple pressure stimuli sensors for controlling the test valve 22 and circulating valve 23 is depicted in FIG. 9. The circulating valve 23 is installed above the test valve 22 in the tool string 5. The circulating valve 23 controls the fluid communication between an upper inner bore 500 of the tool string 5 and the casing-tool annulus 28. The test valve 22 opens and closes the fluid communication between the upper inner bore 500 and a lower inner bore 501.

The tubing pressure sensor 102 above the test valve 22 is ported to the upper inner bore 500. The tubing pressure sensor 104 below the test valve 22 is ported to the lower inner bore 501. The annulus pressure sensor 100 is ported to the casing-tool annulus 28. The electrical signals generated from the sensors 100, 102, 104 are sent to the controller 106 and storage 502, where the tool operation commands are detected and histories of the measurements by the sensors are stored.

Figure 10:
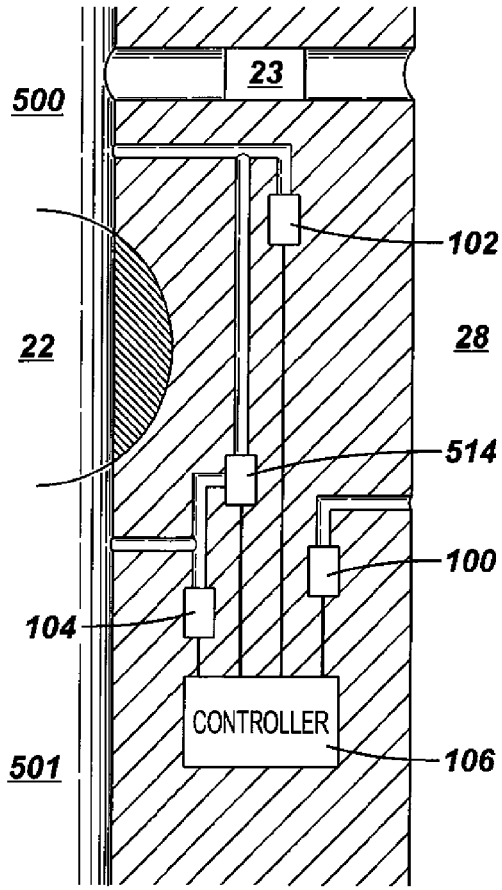
FIG. 10 is a schematic diagram of a differential sensor ported to tubing above and below the a valve, according to an embodiment.

In another embodiment, some or all sensors used in the system may be pressure differential sensors. For example, as depicted in FIG. 10, a pressure differential sensor 514 is provided to directly measure the pressure difference between the upper inner bore 500 and lower inner bore 501. Pressure differential sensors can also be provided to measure pressure difference between the upper inner bore 500 and the annulus 28, and the pressure difference between the lower inner bore 501 and the annulus 28.

In another embodiment of this invention, the test valve 22 between the two tubing sensors may be replaced by a Venturi type of device, which allows for the measurement of flow rate based on pressure measurements from the two tubing sensors.

In another embodiment of this invention, there may be multiple devices between the two tubing sensors. For example, a test valve and a Venturi type of device may exist between the two tubing sensors, so the measurements from these two sensors can be used for both valve control and flow dynamics quantification.

In some embodiments, for example, a concentric or an eccentric coiled tubing is used, the first annulus can be outside an inner-most tubular structure but inside the outer tubular structure that is run with the tool string while the second annulus is the space outside the outer-most tubular structure. The arrangement of plural sensors disclosed can be applied to all flow passageways that are formed from the concentric or eccentric coiled tubing operation.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a wellbore, comprising:

a tool string, a plurality of sensors including at least a first sensor to detect pressure signals including a first sequence of pressure pulses in an inner conduit of the tool string, and at least a second sensor to detect pressure signals including a second sequence of pressure pulses in an annulus outside the tool string; and a controller configured to actuate a tool in the tool string in response to a logical combination of outputs from the sensors, wherein the outputs of the sensors are responsive to the respective pressure signals, wherein the controller is configured to actuate the tool in response to the logical combination of the outputs by:

determining whether the pressure signals received by one of the first and second sensors match a predefined signature;

in response to determining that the pressure signals received by the one of the first and second sensors match the predefined signature, determining whether the pressure signals received by another one of the first and second sensors satisfy a predetermined condition; and actuating the tool in response to the pressure signals received by the one of the first and second sensors matching the predefined signature and the pressure signals received by the another one of the first and second sensors satisfying the predetermined condition.

2. The apparatus of claim 1, wherein the logical combination of outputs is selected from the group consisting of: all outputs of the sensors; a subset of the outputs of the sensors; and a predefined sequence of outputs of the sensors.

3. The apparatus of claim 1, wherein the pressure signals in the inner conduit and pressure signals in the annulus are communicated from an earth surface location.

4. The apparatus of claim 3, further comprising a conveyance tubular structure to carry the tool string into the wellbore, wherein an inner conduit of the conveyance tubular structure is in fluid communication with the inner conduit of the tool string.

5. The apparatus of claim 1, wherein the tool string includes an isolation valve that when closed isolates a lower part of the inner conduit of the tool string from an upper part of the inner conduit, and that when a state of the isolation valve is changed causes a cross-section area of a flow passageway through the isolation valve to change, wherein the first sensor is configured to detect pressure signals in the upper part of the inner conduit above the isolation valve, and wherein the plurality of sensors further include a third sensor to detect pressure signals in the lower part of the inner conduit below the isolation valve.

6. The apparatus of claim 1, wherein the controller is configured to actuate the tool in response to: (1) determining that the pressure signals in the annulus received by the second sensor match the predefined signature; and (2) confirming that the predetermined condition is satisfied by checking the pressure signals in the inner conduit received by the first sensor.

7. The apparatus of claim 6, wherein the controller is configured to confirm that the predetermined condition is satisfied if the pressure signals received by the first sensor are substantially different from pressure signals received by the second sensor.

8. The apparatus of claim 7, further comprising a valve that when opened enables fluid communication between the annulus and inner conduit, and wherein the valve being open prevents the predetermined condition from being satisfied.

9. The apparatus of claim 8, wherein the tool is an isolation valve, and wherein the controller is configured to not change a state of the isolation valve if the controller determines that the predetermined condition is not satisfied.

10. The apparatus of claim 1, wherein the sensors are further configured to detect pressure changes due to fluid flow in the annulus or inner conduit, and wherein the controller is configured to further control actuation of the tool based on the detected pressure changes due to fluid flow.

11. The apparatus of claim 1, further comprising at least one storage device to store the outputs of the plurality of sensors to provide historical information to enable troubleshooting of the tool and/or data analysis for formation property estimation.

12. The apparatus of claim 1, wherein the controller is configured to detect a state of the tool based on at least one of the outputs of the sensors.

13. The apparatus of claim 1, further comprising at least one electrical link connected to the sensors, wherein the at least one electrical link is to extend from an earth surface above the wellbore to enable communication with the sensors.

14. The apparatus of claim 13, wherein the controller is to actuate the tool further based on one or more commands received over the at least one communications link.

15. The apparatus of claim 13, further comprising at least one storage device to store the outputs of the plurality of sensors, wherein the at least one electrical link enables retrieval of data in the at least one storage device by earth surface equipment.

16. The apparatus of claim 1, wherein the controller is configured to not actuate the tool even though the pressure signals received by the one of the first and second sensors match the predefined signature, if the controller determines that the pressure signals received by the another one of the first and second sensors do not satisfy the predetermined condition.

17. A method of controlling actuation of a tool in a tool string deployed in a wellbore, comprising:

providing a plurality of sensors including at least a first sensor to detect pressure signals including a first sequence of pressure pulses in an inner conduit of the tool string and at least a second sensor to detect pressure signals including a second sequence of pressure pulses in an annulus in the wellbore outside the tool string; and actuating, by a controller, a tool in the tool string in response to a logical combination of outputs from the sensors, wherein the outputs of the sensors are responsive to the respective pressure signals, wherein the tool is actuated by the controller in response to:

the controller determining that the pressure signals received by one of the first and second sensors match a predefined signature; and determining that the pressure signals received by another one of the first and second sensors satisfy a predetermined condition after determining that the pressure signals received by the one of the first and second sensors match the predefined signature.

18. The method of claim 17, wherein the logical combination of outputs is selected from the group consisting of: all outputs of the sensors; a subset of the outputs of the sensors; and a predefined sequence of outputs of the sensors.

19. The method of claim 17, further comprising communicating the pressure signals in the inner conduit and pressure signals in the annulus from an earth surface location.

20. The method of claim 17, wherein the tool string includes an isolation valve that when closed isolates a lower part of the inner conduit of the tool string from an upper part of the inner conduit and that when a state of the isolation valve is changed causes a cross-sectional area of a flow passageway through the isolation valve to change, wherein the first sensor detects pressure signals in the upper part of the inner conduit above the isolation valve, the method further comprising:

providing a third sensor in the plurality of sensors to detect pressure signals in the lower part of the inner conduit below the isolation valve.

21. The method of claim 17, wherein actuating the tool is in response to: (1) detecting that the pressure signals in the annulus received by the second sensor match the predefined signature; and (2) confirming that the predetermined condition is satisfied by checking the pressure signals in the inner conduit received by the first sensor.

22. The method of claim 21, the predetermined condition is confirmed to be satisfied if the pressure signals received by the first sensor are substantially different from the pressure signals received by the second sensor.

23. The method of claim 17, further comprising providing at least one storage device to store the outputs of the plurality of sensors to provide historical information to enable troubleshooting of the tool and/or data analysis for formation property estimation.

24. The method of claim 17, further comprising providing at least one electrical link connected to the sensors, wherein the at least one electrical link is to extend from an earth surface above the wellbore to enable communication with the sensors.

25. The method of claim 17, wherein the tool is not actuated by the controller even though the pressure signals received by the one of the first and second sensors match the predefined signature, if the controller determines that the pressure signals received by the another one of the first and second sensors do not satisfy the predetermined condition.

26. The method of claim 17, wherein the tool is a valve that when opened enables fluid communication between the annulus and the inner conduit, and wherein the valve being open prevents the predetermined condition from being satisfied.

* * * * *